US008052456B2

(12) United States Patent
Li

(10) Patent No.: US 8,052,456 B2
(45) Date of Patent: Nov. 8, 2011

(54) SHIELDED ELECTRICAL CONNECTOR

(75) Inventor: Chang-Mao Li, Kunshan (CN)

(73) Assignee: Hon Hai Precision Ind. Co. Ltd., New Taipei (TW)

( * ) Notice: Subject to any disclaimer, the term of this patent is extended or adjusted under 35 U.S.C. 154(b) by 32 days.

(21) Appl. No.: 12/635,724

(22) Filed: Dec. 11, 2009

(65) Prior Publication Data

US 2010/0151718 A1 Jun. 17, 2010

(30) Foreign Application Priority Data

Dec. 11, 2008 (CN) ..... 2008 2 0303318

(51) Int. Cl.
*H01R 13/627* (2006.01)

(52) U.S. Cl. ..... 439/354

(58) Field of Classification Search ..... 439/354, 439/345, 352, 357, 658, 607.45
See application file for complete search history.

(56) References Cited

U.S. PATENT DOCUMENTS 5,383,794 A * 1/1995 Davis et al. ..... 439/352
6,865,369 B2 * 3/2005 Semmeling et al. ..... 434/357
2007/0082509 A1 * 4/2007 Kuo ..... 439/45

FOREIGN PATENT DOCUMENTS

TW 239609 1/1985

* cited by examiner

*Primary Examiner* — Alexander Gilman
(74) *Attorney, Agent, or Firm* — Wei Te Chung; Andrew C. Cheng; Ming Chieh Chang

(57) ABSTRACT

An electrical connector (100) comprises a first connector (1) and a second connector (2) electrically connected together by a printed circuit board assembly (3); a tubular shaped first shielding member (4) enclosing the printed circuit board assembly (3), partial of the first and second connector; a second shielding member (5) assembled to first shielding member and retaining the first connector and the second connector.

15 Claims, 4 Drawing Sheets

SHIELDED ELECTRICAL CONNECTOR

BACKGROUND OF THE INVENTION

1. Field of the Invention

The present invention generally relates to electrical connector, and more particularly to a shielded electrical connector for high-speed transmission.

2. Description of Related Art

TW patent No. 239609 issued to Huang on Jan. 21, 1995 discloses an electrical connector. The electrical connector includes a first connector and a second connector interconnected each other via plurality of wires. The wires with opposite ends thereof are soldered to corresponding contacts of the first connector and the second connector, respectively. The electrical connector may result in lower productive efficiency and higher productive cost. With development of an electronic development, the aforementioned electrical connector is unable to meet complex and powerful function requirement. So an improved electrical connector (adaptor) is emerged in the market. The adaptor includes a first connector and a second connector connected together via a printed circuit board, and some other electronic elements, IC chip, resistor, capacitor etc. are also mounted to the printed circuit board. However ever, those electronic elements are delicate and unable to bear high thermal environment and easily to be damaged.

Hence, an improved electrical connector is highly desired to overcome the disadvantages of the related art.

SUMMARY OF THE INVENTION

Accordingly, an object of the present invention is to provide a shielded electrical connector.

In order to achieve the object set forth, an electrical connector in accordance with the present invention comprises a first connector and a second connector electrically connected together by a printed circuit board assembly; a tubular shaped first shielding member enclosing the printed circuit board assembly, partial of the first and second connector; a second shielding member assembled to first shielding member and retaining the first connector and the second connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
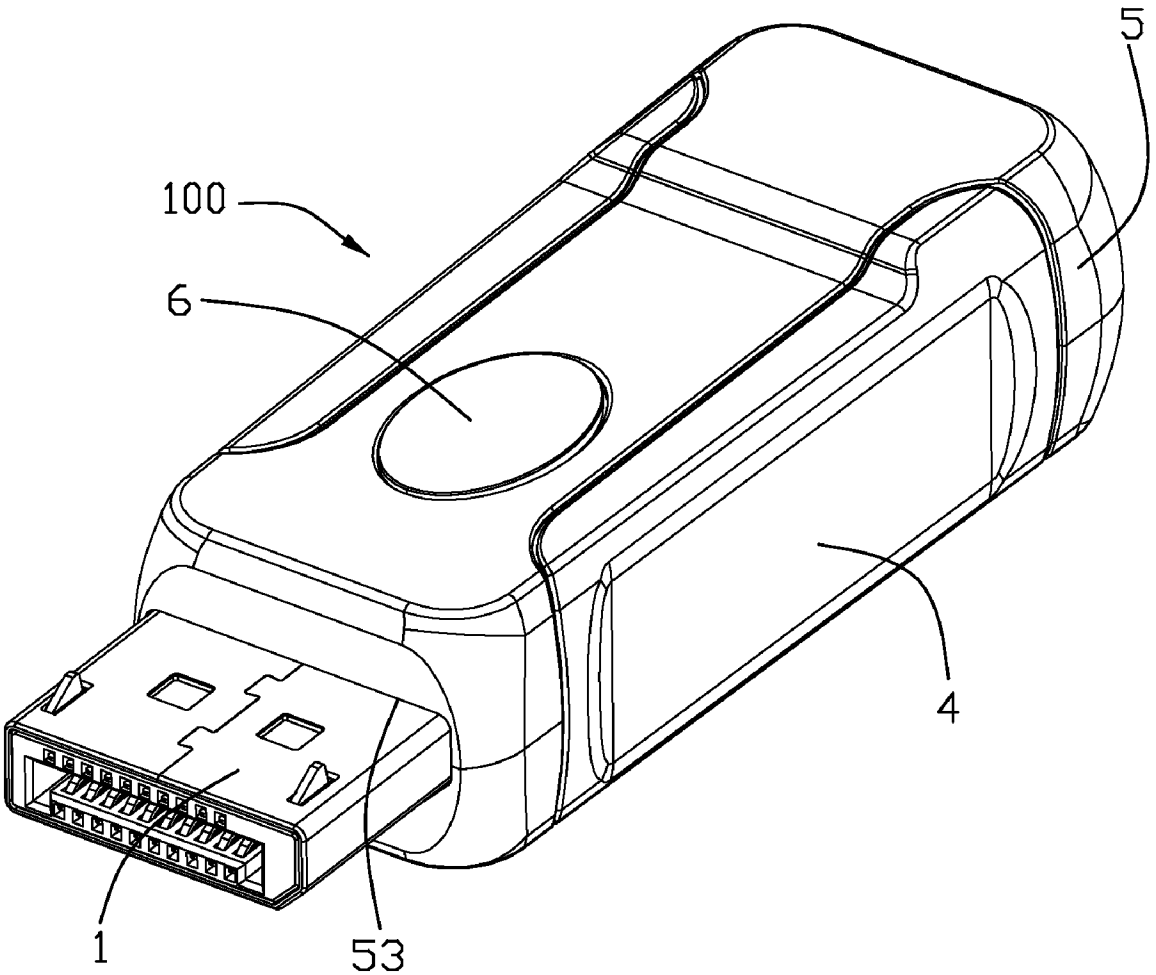
FIG. 1 is an assembled, perspective view of an electrical connector.
Figure 2:
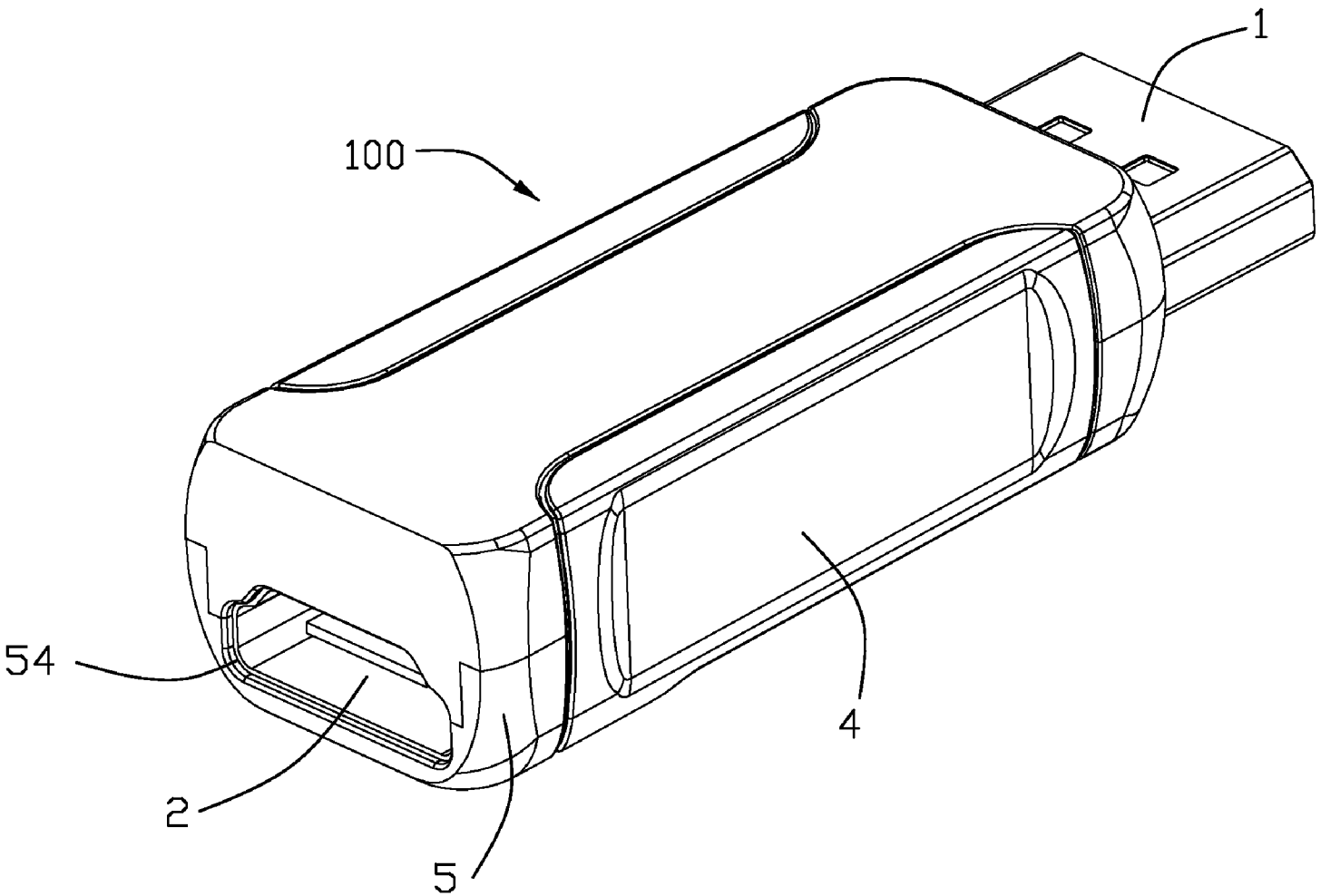
FIG. 2 is a view similar to FIG. 1, but viewed from another aspect.
Figure 3:
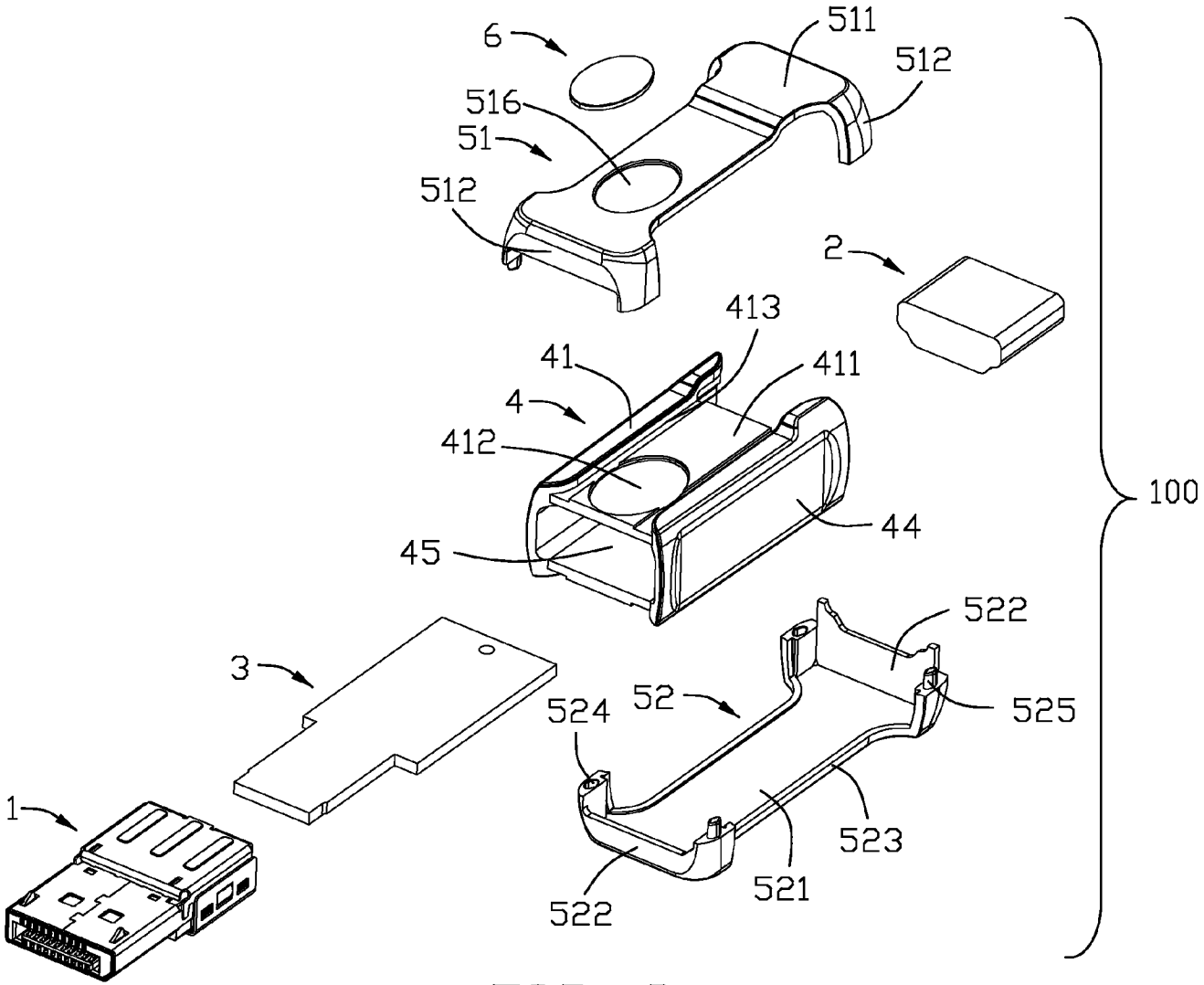
FIG. 3 is an exploded, perspective view of the electrical connector.
Figure 4:
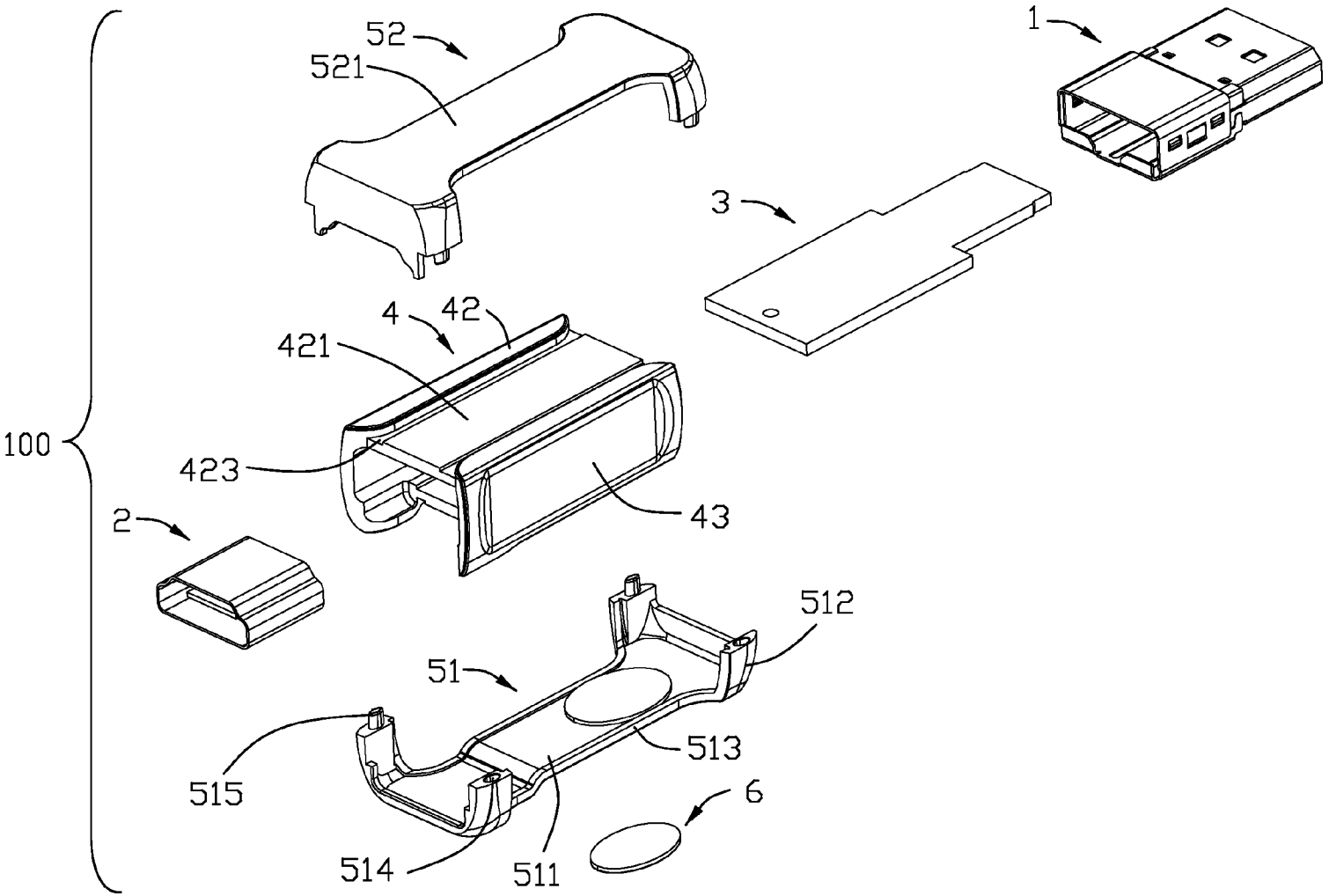
FIG. 4 is a view similar to FIG. 3, but viewed from another aspect.

Referring to FIGS. 1-4, an electrical connector 100 in accordance with the present invention includes a first connector 1, a second connector 2, a printed circuit board assembly (PCBA) 3 for connecting the first connector 1 and the second connector 2, a first shielding member 4 enclosing outside of the PCBA 3, a second shielding member 5. The first connector 1 is compatible with Displayport connector transmitting, and the second connector 2 compliance with HDMI connector transmitting.

The PCBA 3 has a number of IC chip, resistors and capacitors (not shown) mounted thereon. Furthermore, a plurality of conductive pads (not shown) are formed on a front and rear ends of the PCBA 3, respectively. The first connector 1 is disposed in front of the PCBA 3 and with terminals (not numbered) being soldered to the corresponding conductive pads on the front ends of the PCBA 3. The second connector 2 is located behind the PCBA 3 and with contacts (not numbered) being soldered to the corresponding conductive pads on the rear end of the PCBA 3.

The first shielding member 4 is one-piece typed tubular member, which has a top wall 41, a bottom wall 42 and a pair of lateral walls 43, 44 joined with each other to form a hollow 45. The PCBA 3, a rear segment of the first connector 1, a rear segment of the second connector 2 are accommodated in the hollow 45.

A first channel 411 is defined in a middle segment of the top wall 41, an ellipse shaped cavity 412 is located in a front part of the first channel 411. The cavity 412 further communicates with the hollow 45. Two elongated first positioning slots 413 are defined in laterals part of the top wall 41 and communicate with the first channel 411, respectively. A second channel 421 is defined in a middle segment of the bottom wall 42. Two elongated second positioning slots 423 are defined in laterals part of the bottom wall 42 and communicate with the second channel 421, respectively.

The second shielding member 5 includes an upper cover 51 and a lower cover 52. The upper cover 51 has a first main portion 511 and two first engaging portions 512 projecting downwardly from front and rear ends of the first main portion 511. Each first engaging portion 512 respectively defines a crushing rib 515 and a positioning hole 514 on/in free ends thereof A pair of first flange 513 are formed at two lateral sides of the first main portion 511. An ellipse shaped through hole 516 is defined in a front segment of the first main portion 511.

The lower cover 52 has a second main portion 521 and two second engaging portions 522 projecting upwardly from front and rear ends of the second main portion 521. Each second engaging portion 522 respectively defines a crushing rib 525 and a positioning hole 524 on/in free ends thereof A pair of second flanges 523 are formed at two lateral sides of the second main portion 521.

The upper cover 51 is assembled to the first shielding member 4, with the first main portion 511 accommodated in the first channel 411, the first flanges 513 received in the first positioning slots 413. An identifying member (logo) 6 is arranged in the cavity 412 and exposed outside via through hole 516. The lower cover 52 is assembled to the first shielding member 4, with the second main portion 511 accommodated in the second channel 421, the second flanges 513 received in the second positioning slots 423. The first engaging portion 512 is combined with the second engaging portion 522, with the crushing rib 515/525 inserted into the corresponding positioning hole 524/514. The first connector 1 and the second connector 2 are held/retained by the first and second engaging portions 512, 522. The lateral walls 43, 44 are exposed outward.

The PCBA 3 snuggly lies in the hollow 45 of the first shielding member 4, and IC chips, resistors and capacitors thereof are well protected by the first shielding member 4.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a first connector and a second connector electrically connected together by a printed circuit board assembly;

a tubular shaped first shielding member enclosing the printed circuit board assembly and a part of the first and second connector;

a second shielding member assembled to the first shielding member and retaining the first connector and the second connector;

wherein the second shielding member includes an upper cover and a lower cover combined together;

wherein the upper cover has a first main portion and two first engaging portions projecting downwardly from a front and rear ends thereof, and the lower cover has a second main portion and two second engaging portions projecting upwardly from front and rear ends thereof;

wherein the first shielding member has a top wall and a bottom wall connected with a pair of lateral walls to form a hollow to receive printed circuit board assembly therein;

wherein both the top wall and the bottom wall defines first channels and second channels to accommodate the first main portion and the second main portion, respectively.

2. The electrical connector as claimed in claim 1, wherein the first engaging portions and the second engaging portions are engaged with each other by crushing ribs and positioning holes thereof.

3. The electrical connector as claimed in claim 2, wherein the first connector and the second connector are held by the first engaging portions and the second engaging portions.

4. The electrical connector as claimed in claim 1, wherein the top wall and the bottom wall further define first positioning slots and second positioning slots to receive first flanges and second flanges formed at laterals sides of the first and second main portions, respectively.

5. The electrical connector as claimed in claim 1, wherein a through hole is defined in the first main portion and a cavity is defined in the top wall, and an identifying member is arranged in the cavity and exposed outside via through hole.

6. The electrical connector as claimed in claim 1, wherein the pair of lateral walls is exposed outwardly.

7. An electrical adaptor comprising:

an insulative outer case including a one piece unitary tubular part with opposite front and rear openings, and upper and lower parts commonly defining opposite front and rear walls covering said front and rear openings, respectively;

a printed circuit board disposed in the tubular part, with a plurality of conductive pads formed on a front and rear ends thereof soldered to a front connector unit and a rear connector unit;

the front connector unit mounted upon a front region of the printed circuit board and extending through the front wall for mating with a first complementary connector; and the rear connector unit mounted upon a rear portion of the printed circuit board and extending through the rear wall for mating with a second complementary connector.

8. The electrical adaptor as claimed in claim 7, wherein each of said front wall and said rear wall is composed by both said upper part and said lower part.

9. The electrical adaptor as claimed in claim 8, wherein said each of said upper part and said lower part includes a portion extending over essentially a full length of the tubular part axially.

10. The electrical adaptor as claimed in claim 9, wherein said each of said upper part and said lower part defines an I-like configuration in an elevational view.

11. The electrical adaptor as claimed in claim 7, wherein said upper part and said lower part are located outside of the tubular part.

12. An electrical adaptor comprising:

an insulative outer case including a one piece unitary tubular part defining front and rear openings, and two pieces upper and lower parts cooperating with front and rear connectors, which are respectively located around a front and rear openings, to partially cover said front and rear openings along an axial direction of the tubular part; wherein said front connector and said rear connector are electrically connected to each other via a printed circuit board which is enclosed in the tubular part; wherein the printed circuit board substantially extends through both ends of the tubular part to reach the corresponding front and rear connectors, respectively.

13. The electrical adaptor as claimed in claim 12, wherein each of said front and rear connectors is retained and sandwiched between the upper part and the rear part in a vertical direction perpendicular to said axial direction.

14. The electrical adaptor as claimed in claim 13, wherein said upper and lower parts are located outside of the tubular part.

15. The electrical adaptor as claimed in claim 12, wherein the tubular part and the upper and lower parts have a similar length along an axial direction.

* * * * *